United States Patent [19]

Dix et al.

[11] 4,044,567

[45] Aug. 30, 1977

[54] MODULAR, MAGNETICALLY-COUPLED DRIVE FOR A CRYOGENIC REFRIGERATOR

[75] Inventors: Robert M. Dix; Samuel F. Tobias; Stephen L. Whicker, all of Dallas, Tex.

[73] Assignee: Texas Instruments Incorporated, Dallas, Tex.

[21] Appl. No.: 609,850

[22] Filed: Sept. 2, 1975

[51] Int. Cl.[2] ..... F25B 9/00

[52] U.S. Cl. ..... 62/6; 310/104; 417/420

[58] Field of Search ..... 62/6; 310/103, 104; 417/420

[56] References Cited

U.S. PATENT DOCUMENTS

| | | | |
|---|---|---|---|
| 3,205,827 | 9/1965 | Zimmerman | 310/104 X |
| 3,423,948 | 1/1969 | Cowans | 62/6 |
| 3,703,653 | 11/1972 | Tracy et al. | 310/103 X |
| 3,744,261 | 7/1973 | Lagodmos | 62/6 |
| 3,932,068 | 1/1976 | Zimmerman | 310/104 X |
| 3,933,000 | 1/1976 | Doody | 62/6 |

*Primary Examiner*—Ronald C. Capossela
*Attorney, Agent, or Firm*—Harold Levine; Rene E. Grossman; Alva H. Bandy

[57] ABSTRACT

An improved Vuilleumier cycle refrigerator is disclosed. To reduce fluid contamination and inactive refrigerant volume, the hot and cold fluid displacers of the refrigerator are driven by a magnetic drive mechanism. The magnetic drive mechanism has a first and second assembly. The first assembly is contained in the fluid chamber together with the hot and cold displacers; the second assembly including the drive motor is mounted exteriorly of the fluid chamber. The first and second assemblies of the drive mechanism include adjacent magnets separated by the wall of the fluid chamber. Thus, the first and second assemblies are coupled together by their magnetic field for rotation to drive the hot and cold displacers and the fluid chamber provides an hermetic seal to contain the working fluid thereby removing the motor with its air space and contaminants from the fluid chamber.

8 Claims, 6 Drawing Figures

P2
90
P2
94
PRESSURE
102
98
P1
VOLUME

P2
P2
92
96
PRESSURE
104
100
P1
VOLUME

MODULAR, MAGNETICALLY-COUPLED DRIVE FOR A CRYOGENIC REFRIGERATOR

This invention relates to cryogenic coolers, and more particularly, to an improved Vuilleumier cycle cryogenic refrigerator.

In the past, the Vuilleumier refrigeration cycle has not been used to the extent of other refrigeration cycles such as the Stirling cycle because it is not as efficient. However, with the requirement for miniature, flightweight, cryogenic coolers to cool the low heat loads associated with infrared detectors and other cryoelectronic devices, Vuilleumier coolers offer inherent advantages. For example, the cycle can produce cryogenic refrigeration with a source of heat as the only input required. Thus, in space applications, the heat source is obtainable from a solar cell.

The Vuilleumier cycle operates through the use of displacers requiring minimal seals, as the pressures throughout the system are nearly equal at any moment. The displacers simply move the gas from one section to another without the requirement to mechanically compress the gas within a closed volume. Thus, an electric motor producing minimal amount of power is required to move the displacers.

Nevertheless, the electric motor, in the past, has contributed to two fundamental problems encountered in the design of a Vuilleumier cooler; i.e., minimizing inactive volumes in the system to increase the pressure ratio, and reducing clogging contaminants in the working fluid.

The electric motor that operates in the fluid system increases the void volume and provides a source of contaminants. The air gap between the motor's rotor and stator, rotor bearings, and clearance at the end of the motor represent a significant portion of the void volume that reduces the ratio between the maximum and minimum cycle pressure; and the varnishes, epoxies and encapsulants employed in the motor windings are major sources of working fluid contamination. In prior art systems, one approach to solving these problems has been to place the motor stator external to the fluid chamber and the rotor within the fluid chamber. Thus, the rotor is separated from the stator by the metal cylinder containing the fluid. In this manner, contamination from the stator windings is eliminated. However, the void volume remains large and the efficiency of the motor is reduced by the metal cylinder in the air gap. Another approach has been to place the motor assembly in the crankcase, but sealed from the working volume. A drive shaft runs from the motor through a dynamic seal, to the displacer attachment mechanism. This reduces the void volume and fluid contamination. However, reliability and operating life are reduced as the system is dependent upon the life and performance of the seal.

Accordingly, it is an object of this invention to provide an improved Vuilleumier cycle refrigerator.

Another object of the invention is to provide a Vuilleumier cycle refrigerator having an improved pressure ratio for increasing cooling efficiency.

Still another object of the invention is to provide a Vuilleumier cycle refrigerator having minimum fluid contaminants in the fluid chamber.

Yet another object of the invention is to provide a modular magnetically coupled drive for a cryogenic cooler.

Briefly stated the invention comprises in a Vuilleumier cycle refrigerator a fluid chamber containing hot and cold displacers and a first assembly of a magnetic drive mechanism. A second assembly of the magnetic drive mechanism including a drive motor is mounted exteriorly of the fluid chamber. The second assembly is in modular form for ready replacement during refrigerator repair. The first and second assemblies of the magnetic drive mechanism include adjacent magnets separated by the wall of the fluid chamber. Thus, the first and second assemblies of the magnetic drive mechanism are coupled together by the magnetic field of the magnets for rotation, and the fluid chamber provides an hermetic seal to contain the working fluid throughout actuation of the hot and cold displacers by the magnetic drive mechanism.

The novel features characteristic of the invention, together with other objects and advantages, may best be understood by reference to the following detailed description when used in conjunction with the accompanying drawings wherein.

Figure 1:
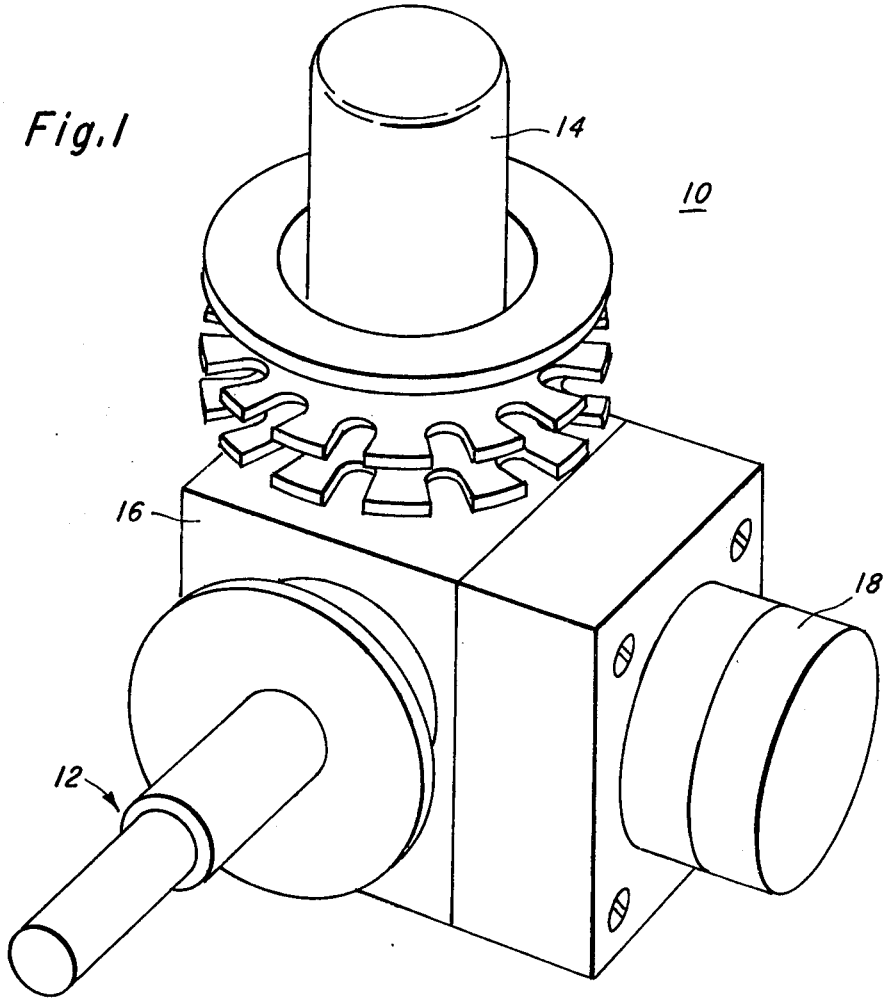
FIG. 1 is an isometric view of a Vuilleumier cycle refrigerator incorporating an embodiment of the invention.

Referring to the drawings, there is shown in FIG. 1 a basic two stage Vuilleumier refrigerator 10. The cold cylinder 12 and hot cylinder 14 are formed at right angles to each other and integral with crankcase 16. A modular d.c. or a.c. motor 18 and magnetic drive is coaxially aligned and attached to the crankcase 16 normal to the cold and hot cylinders 12 and 14. The attachment may be by means of screws or a plug-in attachment.

Figure 2:
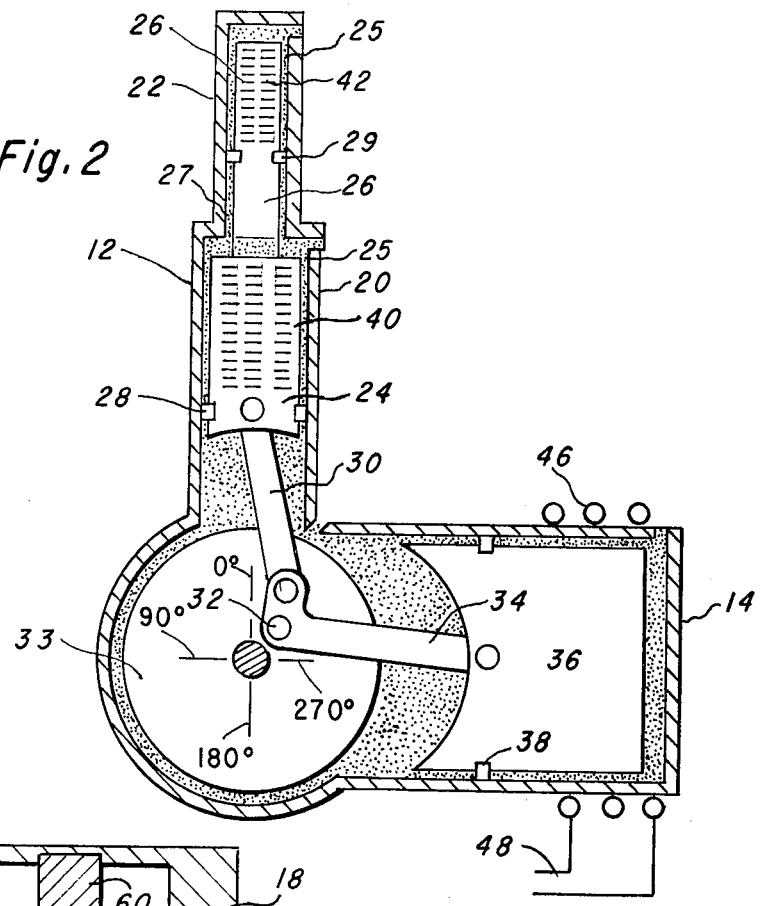
FIG. 2 is a cross sectional view of a Vuilleumier cryogenic refrigerator.

Referring now to FIG. 2, the cold cylinder 12 has, for example, two portions 20 and 22 of different diameters. A first stage displacer 24 is formed, for example, integral with a second stage displacer 26. The first and second stage displacers 24 and 26 are mounted, respectively, in portions 20 and 22 of the cold cylinder 12. Open ring spacers 28 and 29 position the first and second stage displacers 24 and 26 within portions 20 and 22, respectively, of the cold cylinder 12 to form fluid working volumes between the cold cylinder and first and second stage displacers. The first and second displacers 24 and 26 have a plurality of apertures 25 adjacent to their upper ends, and the second stage displacer has a plurality of apertures 27 adjacent to its lower end. The apertures 25 permit the free flow of the working fluid such as, for example, helium between the first and second stage displacers and the cold cylinder; the apertures 27 permit the flow of the working fluid from the first stage displacer to the second stage displacer. A first arm 30 of a double arm connecting rod is connected at one end to displacer 24 and at the other end to crankthrow 32 or a pin eccentrically mounted upon a space filling cylinder 33. The cylinder 33 reduces substantially the working volume within the crankcase. The other arm 34 of the double arm connecting rod is attached at one end to the eccentric pin 32 and at its other end to a hot volume displacer 36. The hot volume displacer 36 is reciprocally mounted in the hot cylinder 14 and open ring spacer 38 positions the hot volume displacer 36 within the cylinder to form a fluid working volume therebetween.

Refrigeration is developed at a desired load temperature by the use of thermal regenerators 40 and 42. Thermal regenerator 42 is mounted in the second stage displacer and acts as a heat exchanger to absorb energy from the working fluid flowing from first stage. Regenerator 40 is mounted in the first stage displacer and acts as a heat exchanger to absorb energy from the working fluid flowing from the ambient crankcase. The fluid working volume between the hot volume displacer and hot cylinder acts as a regenerative heat exchanger to absorb energy from the working fluid flowing from the hot end of the hot cylinder to the ambient crankcase. The regenerators 40 and 42 are identical in construction and include a matrix having a high ratio of surface area to volume such as, for example, an array of stacked fine mesh screens.

The outer end portion of the hot cylinder 14 is heated by a thermal heater 46 coupled to the source of power 48 at a high temperature such as, for example, about 1250° F.

Figure 3:
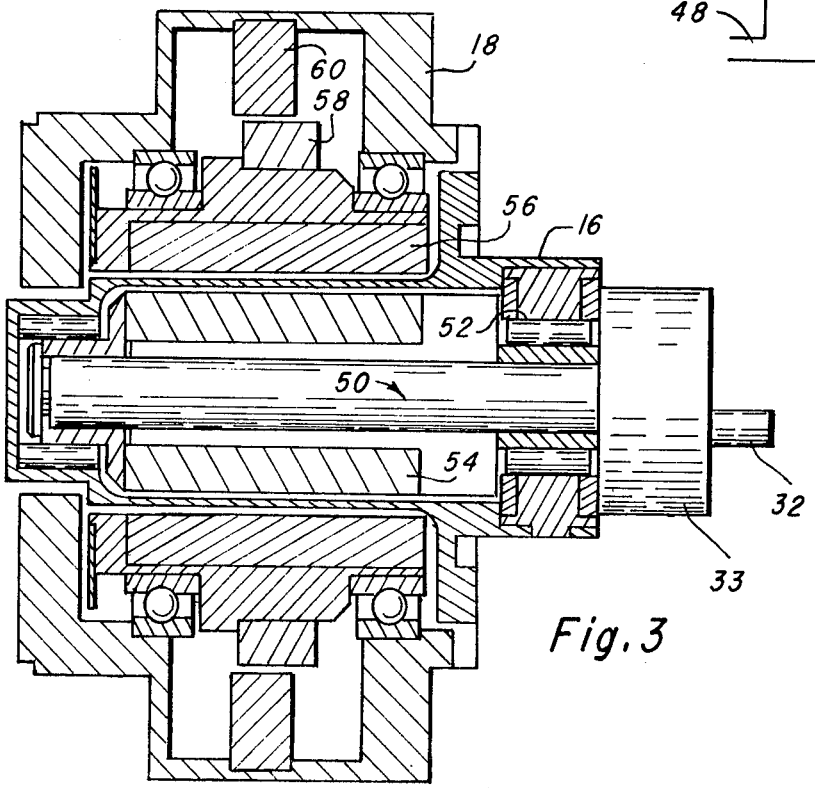
FIG. 3 is a cross sectional view of a first embodiment of the invention.

Referring now to FIG. 3, the eccentric or crank throw 32 mounted upon cylinder 33 is mounted within crankcase 16. The crankcase 16 extends rearwardly to form a cylindrical housing for a drive shaft 50. The drive shaft is mounted in bearings 52 and attached to or formed as an integral part of the cylinder 33. The shaft 50 has fixed thereto an inner magnet 54. The magnet 54 may be constructed of any magnetic material free of fluid contaminants such as, for example, samarium cobalt and may be cylindrical in shape. A module containing an outer magnet 56 and drive motor 18 is attached to the crankcase. The outer magnet 56 corresponding to the magnet 54 is supported by the rotor 58 of d.c. motor 18 about the cylindrical extension of crankcase housing 16, adjacent the first magnet 54. Stator 60 of motor 18 is coupled to a source of d.c. power (not shown) for driving the motor rotor which rotates the attached magnet 56. The magnetic field between the magnets 56 and 54 locks the magnets together for rotation. The portion of the crankcase extending between the magnets forms an hermetic seal sealing the fluid within the crankcase. In this manner the motor is removed from the working volume to reduce its size and source of contamination. Rotating magnet 54 rotates the drive shaft 50 and the eccentric pin 32 attached thereto rotates to selectively move the hot and cold displacers as hereinafter described. As there is no compression work performed by the displacers, the drive motor needs only a few watts of power and the magnets provide adequate locking power for magnetically coupling the drive shaft to the rotor without slippage. This arrangement increases the reliability and life time of the refrigerator by eliminating the seal required for mechanical arrangements passing through the crankcase.

Figure 4:
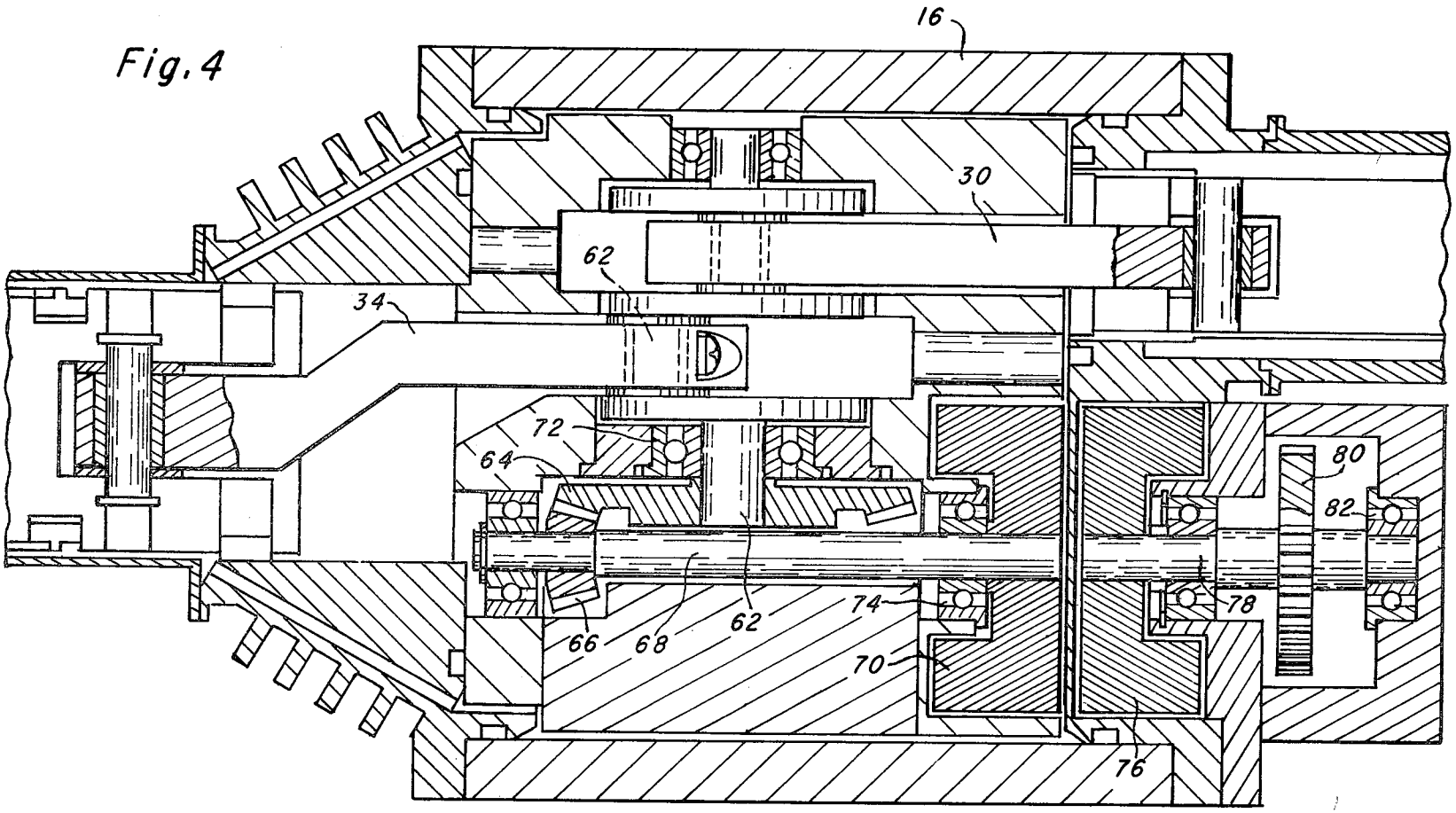
FIG. 4 is a cross sectional view of a second embodiment of the invention.

Referring to FIG. 4, for a description of another embodiment, there is shown an in line drive structure; i. e., a structure in which the motor and displacer drive system are in line. In this embodiment the arms 30 and 34 of the connecting rod are mounted on a double crankshaft 62 in crankcase 16. A ring gear 64 is mounted on the crankshaft 62 and meshes with a bevel gear 66. Bevel gear 66 is mounted for rotation with drive shaft 68. Drive shaft 68 has an inner magnet 70 rigidly attached thereto adjacent the end of the crankcase. The crankshaft 62 and drive shaft 68 are journaled, respectively, in bearings 72 and 74. An outer magnet 76, i.e., a magnet corresponding to the inner magnet and positioned adjacent thereto but outside the crankcase 16 is mounted on the end of a drive shaft 78. The drive shaft 78 is attached to a spur gear 80 mounted between bearings 82. Spur gear 80 is driven by a reduction gear mounted upon the drive shaft (not shown) of a.c. motor 18. The reduction gear arrangement is required to adapt the speed of an a.c. motor to the operating speed of the displacers. The inner magnet 70 and outer magnet 76 are locked together by the magnetic fields. The crankcase 16 forms a hermetic seal sealing the fluid within the crankcase or fluid chamber 16 to reduce the working volume and prevent fluid contamination by removing the motor from the working volume. Reliability and lifetime of the refrigerator is increased by eliminating any mechanical structure connecting the displacers to the motor through the crankcase 16.

Figure 5:
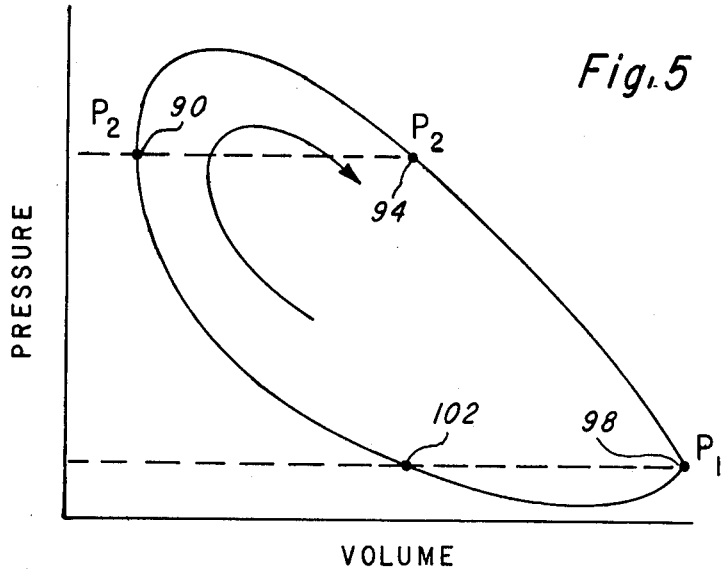
FIG. 5 is a diagram of pressure-volume relationship within the cold cylinder.
Figure 6:
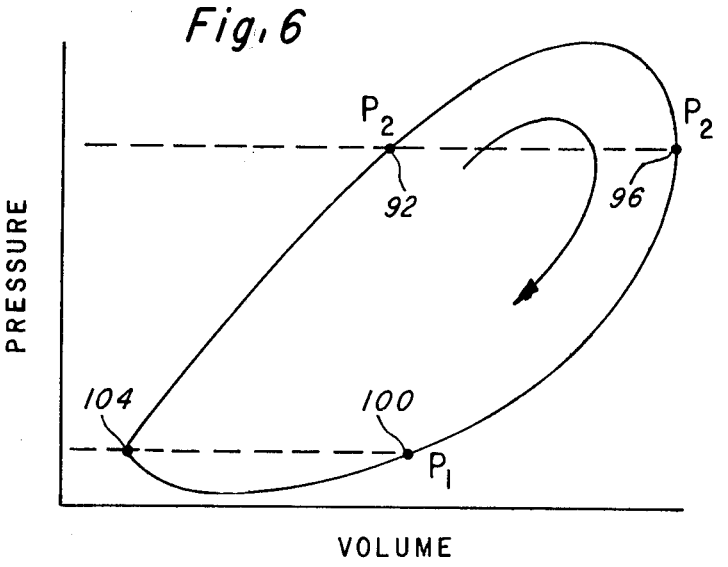
FIG. 6 is a diagram of pressure-volume relationship within the hot cylinder.

Referring to FIGS. 5 and 6 for a description of the operation of the Vuilleumeir cycle refrigerator 10, when the motor 18 drives the crankshaft top dead center, the pressure in the working volume assumes some value $P_2$ in the cold and hot cylinders 12 and 14 are shown, respectively, at points 90 and 92 (FIGS. 5 and 6). As the crankshaft turns counterclockwise 90°, the hot volume displacer moves the working fluid from the ambient crankcase toward the hot end; whilst the cold volume displacer moves it from the ambient crankcase to the cold end. The pressure varies to points 94 and 96; however, the effect is that a certain amount of the working gas is transferred to the cold end of the cold cylinder with little net change in pressure. With the crankshaft moving to the 180° position, the hot displacer moves the working fluid from the hot end to the ambient crankcase and the cold displacers continue to move the working fluid to the cold end. The pressure decreases to value $P_1$ as shown at points 98 and 100 thereby expanding the working fluid. At the 270° position, the hot and cold volume displacers move the working fluid to the ambient crankcase as shown at points 102 and 104. Further movement to the zero or 360° position causes the hot displacer to move the working fluid from the ambient crankcase to the hot end, and the cold displacer to continue to move the working fluid to the ambient crankcase. The pressure returns to the value $P_2$ thereby compressing the fluid. The work removed from the gas at the cold end produces refrigeration. The regenerators 40 and 42 permit gas expansion to occur at a temperature lower than ambient to which the hot gas in the hot cylinder is cooled in the hot regenerator as it circulates to the crankcase. When the gas circulates from the crankcase at ambient temperature through the regenerators to the cold end, heat is absorbed by the matrix element and a thermal gradient is produced in the regenerator. When the gas flows from the cold end, it absorbs heat from the regenerator and becomes ambient at the crankcase. In practical applications heat must be supplied to provide the hot cylinder with thermal energy to maintain a working cyclic pressure.

It will be understood by those skilled in the art that although two embodiments have been described various modifications to the details of construction shown and described may be made such as, for example, reducing the cold cylinder to a single stage or more than two stages to obtain a desired temperature without departing from the scope of this invention.

What is claimed is:

1. A Vuilleumier refrigerator comprising a. a housing having a cold cylinder portion, a hot cylinder portion and a crankcase portion including a cylindrical portion, said hot and cold cylinder portions in open communication with said crankcase portion;

b. a working fluid within said housing;

c. a cold volume fluid displacer slidably positioned within said cold cylinder portion for forming a working volume within the cold cylinder portion;

d. a regenerator mounted within said cold volume fluid displacer;

e. a hot volume fluid displacer slidably positioned within said hot cylinder portion for forming a working volume within the hot cylinder portion;

f. a heating means for heating the working fluid in the hot cylinder portion;

g. a crankshaft means mounted within the crankshaft portion, said crankshaft means including a crankshaft, means connecting the hot and cold volume fluid displacers to the crankshaft for selective movement as to each other, and a cylindrically shaped magnet coupled to rotate the crankshaft, said magnet supported by the crankshaft in the cylindrical portion of the crankcase housing portion; and h. a modular prime mover means including a housing detachably mounted on the crankcase housing portion, a cylindrically shaped stator, a corresponding cylindrically shaped rotor rotatably mounted in the housing for rotation within the cylindrical motor stator, a cylindrically shaped magnet attached interiorally of the motor rotor for rotation therewith, said cylindrical magnet of the rotor corresponding to the cylindrical portion of the crankcase housing portion housing the cylindrically shaped crankshaft magnet whereby said magnets are locked for rotation.

2. A Vuilleumier refrigerator according to claim 1 wherein the cylindrical housing portion of the crankcase is of thin metal.

3. A Vuilleumier refrigerator according to claim 1 wherein the magnets are of samarium cobolt materials.

4. A Vuilleumier refrigerator according to claim 1 wherein the hot and cold volume fluid displacers are spaced from the hot and cold cylinders by a spacing means.

5. A Vuilleumier refrigerator comprising:

a. a housing having a cold cylinder portion, a hot cylinder portion and a crankcase portion, said hot and cold cylinder portions in open communication with said crankcase portion;

b. a working fluid within said housing;

c. a cold volume displacer slidably positioned within said cold cylinder portion for forming a working volume within the cold cylinder portion;

d. a regenerator mounted within said cold volume fluid displacer;

e. a hot volume fluid displacer slidably positioned within said hot cylinder portion for forming a working volume within the hot cylinder portion;

f. a heating means for heating the working fluid in the hot cylinder portion;

g. a crankshaft means mounted within the crankcase portion, said crankcase means including a crankshaft, connecting rods connecting the hot and cold volume fluid displacers to the crankshaft for selective movement as to each other, and a magnet vertically disposed to the crankshaft center line, and connected adjacent to the crankshaft and end of the crankshaft housing portion; and h. a modular prime mover means having an open faced housing, a stator, a rotor means including a rotor and a second magnet mounted in said housing, said magnet attached to the rotor means in a vertical position corresponding to the vertical crankshaft magnet in the crankcase, said open faced housing having its open face attached to the crankshaft housing to position the vertical magnet in operative association with the crankshaft magnet.

6. A Vuilleumier refrigerator according to claim 5 wherein the rotor means of the modular prime mover means further includes a first drive shaft section connected to the rotor, reduction gear means coupled to the first drive shaft section, a second drive shaft section coupled to the reduction gear means and to the magnet mounted for rotation on the second drive shaft section to adapt the speed of the motor to the operating speed of the displacers.

7. A Vuilleumier refrigerator according to claim 5 wherein the crankshaft means includes a double crank crankshaft connected to the connecting rods of the hot and cold volume fluid displacers intermediate the hot and cold volume fluid displacers, a gear means including a pair of gears having work surfaces inclined to nonparallel axis, a first one of said gears mounted upon the double crank crankshaft, the second of said gears mounted upon a drive shaft, the second gear in meshing engagement with the first gear, a first magnet mounted upon the drive shaft; and wherein the prime mover includes a second magnet mounted upon a drive shaft aligned with the drive shaft of the crankshaft means, whereby the hot and cold cylinder portions are in substantial alignment with the longitudinal axes of the hot and cold crankshaft cylinder portions thereby providing a Vuilleumier refrigerator having a long narrow profile.

8. A Vuilleumier refrigerator according to claim 7 wherein the hot and cold volume fluid displacers relative movement is determined by the angular displacement of the cranks of the double crank crankshaft.

* * * * *